US008056454B2

(12) United States Patent
Diaz

(10) Patent No.: US 8,056,454 B2
(45) Date of Patent: Nov. 15, 2011

(54) SERRATED KNIFE

(76) Inventor: Scott Douglas Diaz, Galliano, LA (US)

( * ) Notice: Subject to any disclaimer, the term of this patent is extended or adjusted under 35 U.S.C. 154(b) by 357 days.

(21) Appl. No.: 12/082,109

(22) Filed: Apr. 9, 2008

(65) Prior Publication Data

US 2009/0255135 A1 Oct. 15, 2009

(51) Int. Cl.
*B26B 3/00* (2006.01)

(52) U.S. Cl. ..... 83/13; 30/314; 30/353

(58) Field of Classification Search ..... 30/314, 30/317, 166.3, 357, 501, 355, 353, 502, 503; D8/20, 98, 101; D22/118; 83/13
See application file for complete search history.

(56) References Cited

U.S. PATENT DOCUMENTS 398,350 A * 2/1889 Shepley ..... 30/502
495,110 A 4/1893 Hayes et al.
519,251 A * 5/1894 Feneran ..... 30/315
1,886,560 A * 11/1932 Lee ..... 30/355
1,954,250 A * 4/1934 Lee ..... 172/375
D99,855 S 6/1936 Coughlan
2,059,414 A 11/1936 Taylor
2,517,840 A 9/1946 Chatlos
2,636,267 A 4/1953 Whitcomb
D175,248 S 8/1955 Carroll
2,845,706 A * 8/1958 Aciego ..... 30/346
3,015,930 A * 1/1962 Campbell ..... 30/314
3,605,268 A 9/1971 Cassell, Sr.
3,918,158 A * 11/1975 Debski ..... 30/314
4,425,706 A * 1/1984 Southworth et al. ..... 30/116
4,787,146 A * 11/1988 Gaskins ..... 30/351
6,427,333 B1 8/2002 Veltz et al.

* cited by examiner

*Primary Examiner* — Stephen Choi
(74) *Attorney, Agent, or Firm* — Keaty Law Firm LLC

(57) ABSTRACT

A knife has a cutting blade with an elongate planar body having a front and a back, a first and second opposite edges, the elongate body having a centerline extending between the first and the second edges, each of said first and second edges being provided with a plurality of angularly-oriented notches defined by beveled surfaces, which intersect to form cutting edges. The notches have a generally V-shaped configuration and have one or more sides that extend at an acute angle in relation to the centerline.

7 Claims, 2 Drawing Sheets

SERRATED KNIFE

BACKGROUND OF THE INVENTION

This invention relates to knives, and more particularly to utility knives that are used for cutting high density materials, such as ropes, cables and the like.

Knives with serrated cutting edges are old and well-known in the prior art. The serrated blades are conventionally used in household tools, such as table knives and meat cutting knives and a wide variety of saw blades, straight, circular, and band.

However, other than such saw blades, serrated cutting devices have not proved particularly useful in industrial applications such as, for example, hand cutting of ropes, bundles of twine, and the like. Most often, the cutting implement is in a form of a single edge blade that has a sharp edge formed along one edge, while the other edge is dull to protect the user's hand. Such blades are particularly ineffective when a user needs to cut through a thick rope. Small boat operators often encounter a problem when a rope becomes entangled on a propeller or a shaft of a marine vessel and divers have to be called to free the propeller from the shaft to return the vessel to operation.

A rope is a length of fibers, twisted or braided together; it is thicker and stronger than similarly constructed cord, line, string, or twine. Common materials for rope include natural fibers such as Manila hemp, hemp, linen, cotton, coir, jute, and sisal. Synthetic fibers in use for rope-making include polypropylene, nylon, polyesters, polyethylene. Some ropes are constructed of mixtures of several fibers or use co-polymer fibers. Ropes can also be made out of metal fibers. The rope may be constructed in a variety of ways, such as for instance by twisting several strands, by braiding the strands into single or double braids, or by braiding twisted strands for the so-called square braid. Needles to say, the braided and twisted rope are strong, have high tensile strength and are flexible.

While current state-of-art utility knives using single-edge cutting blades are functional in many circumstances, they dull quickly when applied for the cutting of a multi-strand rope, resulting in cutting operations that are laborious and time consuming. The job of cutting a rope under water is even more difficult.

The present invention contemplates elimination of drawbacks associated with the prior art and provision of a utility knife blade that can be beneficial in cutting multi-strand ropes and other such objects, either above or under water.

SUMMARY OF THE INVENTION

It is therefore an object of the present invention to provide a knife with a double-edge blade capable of cutting high-density materials, such as ropes.

It is another object of the present invention to provide a serrated cutting blade that can be used for cutting ropes and similar objects in an accurate and efficient manner, with minimal fraying of the rope.

These and other objects of the invention are achieved through a provision of a cutting blade for use on a hand held cutting device, the cutting blade comprising an elongate planar body having a front and a back, a first and second opposite edges, the elongate body having a centerline extending between the first and the second edges, each of said first and second edges being provided with a plurality of angularly-oriented notches defined by beveled surfaces, which intersect to form cutting edges. The notches have a generally V-shaped configuration and are defined by a pair of sides that are oriented at an acute angle in relation to the centerline.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
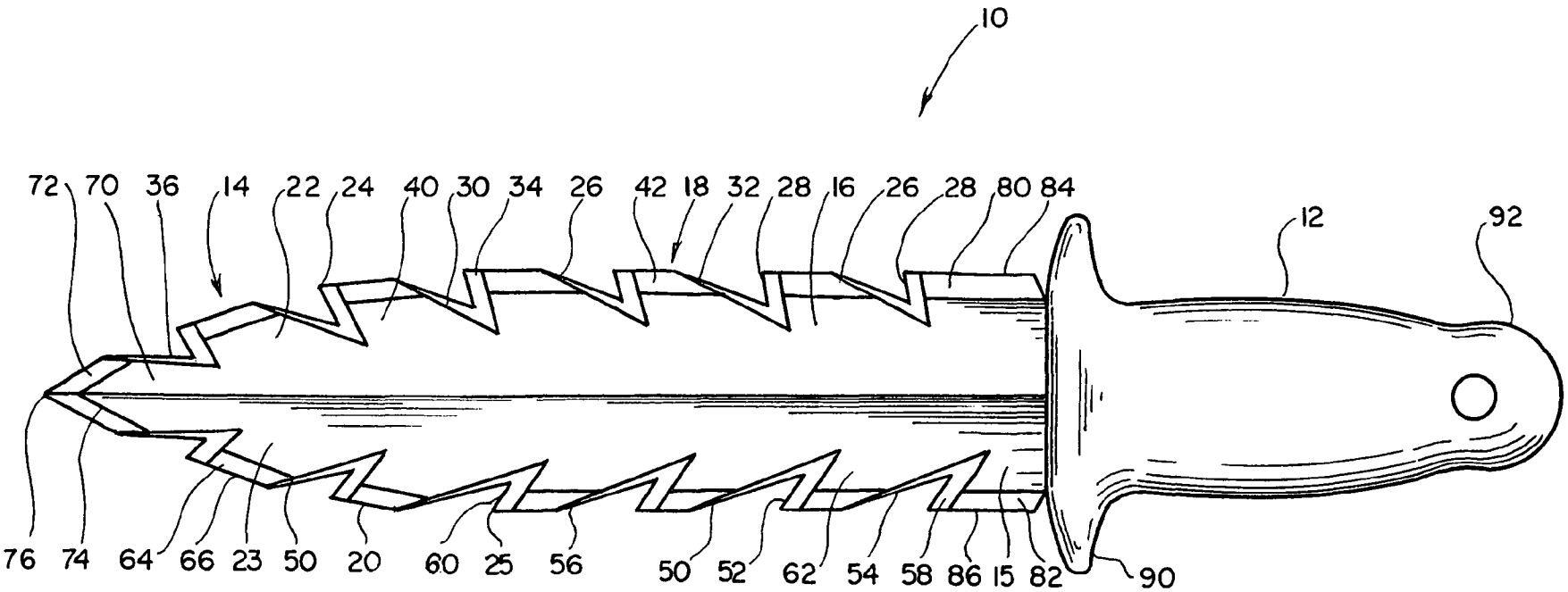
FIG. 1 is a plan view of the knife according to the present invention.

Turning now to the drawings in more detail, numeral designates a knife in accordance with the present invention. The knife 10 comprises a handle 12 and a blade 14 secured to the handle 12 at a proximate end 15. The blade 14 comprises a front, 16, a back 17, which is a mirror image of the front 16, a first edge 18 and a second edge 20.

The first edge 18 and the second edge 20 each comprise a plurality of sharpened teeth 22, 23, respectively, each of the teeth 22 having a distal end 24 extending away from a central longitudinal axis, or centerline X of the blade 14. A line connecting each of the distal ends 24 actually defines the first edge 18. Each of the teeth 23 has a distal end 25, which extends away from the central axis X of the blade 14. A line connecting each of the distal ends 25 defines the second edge 20.

Each of the teeth 22 comprises a first serration side 26 and a second serration side 28. The first serration side 26 comprises a pair of beveled surfaces 30, although only one is seen in the drawings. The opposite surface of the side 26 is similarly provided with an inclined bevel, which is a mirror image of the surface 30. The beveled surfaces meet at a sharp apex line 32. Similarly, the side 28 is formed by mirror-image beveled surfaces 34 that meet at a sharp apex 36. The second serration side 28 extends at an acute angle in relation to the longitudinal axis X. This angle can be selected to be within the preferred range of between 45 and 70 degrees. In FIG. 1, the exemplary inclination of the second side 28 is about 70 degrees.

Extending between the distal end 24 and the side 22 of the blade edge 18 is a portion 40, which has beveled surfaces 42 formed on opposite sides of the blade 14. The beveled surfaces 42 of the portion 40 meet at a sharp apex 42. An imaginary line extending along the apex segments 42 forms the first edge 18 of the blade 14.

The second edge 20, similarly to the edge 18 is provided with a plurality of beveled teeth segments formed in the teeth 23. Each of the teeth 23 has a first serration side 50 and a second serration side 52. The first serration side 50 comprises a pair of beveled surfaces 54, although only one can be seen in FIG. 1. The opposite side of the blade 14 is provided with a beveled surface, which is a mirror image of the bevel surface 54. The beveled surfaces 54 culminate in a sharp apex 56. The second serration side 52 is similarly formed with two beveled surfaces 58, which meet at a sharp apex 60. The second serration side 52 of the edge 20 extends at an acute angle in relation to the central axis X, which angle can be selected to be within the preferred range of between 40 and 70 degrees. In the embodiment shown in FIG. 1, the angle of inclination of the second side 52 is about 45 degrees.

Depending on the manufacturer's choice the second sides 28, 52 can extend at the same angle in relation to the central axis X or extend at different angles, as shown in FIG. 1.

Extending between the distal end 25 and the side 50 of the blade edge 20 is a portion 62, which has beveled surfaces 64 formed on opposite sides of the blade 14. The beveled surfaces 64 of the portion 62 meet at a sharp apex 66. An imaginary line extending along the apex segments 66 forms the second edge 20 of the blade 14.

The blade 14 further comprises a pointed distal end 70, which has a generally pyramidal configuration, with sharpened bevel surfaces 72, 74 formed on both sides of the blade 14. A sharp point 76 is formed at the location where the bevel surfaces 72, 74 intersect.

The proximate end 15 of the blade 14 is similarly formed with bevel surfaces 80, 82 formed along the edges 18 and 20, respectively. The bevel surfaces 80 meet at a sharp apex line 84, while the bevel surfaces 82 form a sharp apex line 86.

The handle 12 can be of several designs, one of the preferred designs having a hand guard 90 extending about the periphery of handle 12. If desired an opening 92 can be formed in the handle 12 to allow suspension of the knife 10 on a string or cable from a belt of a user.

Figure 2:
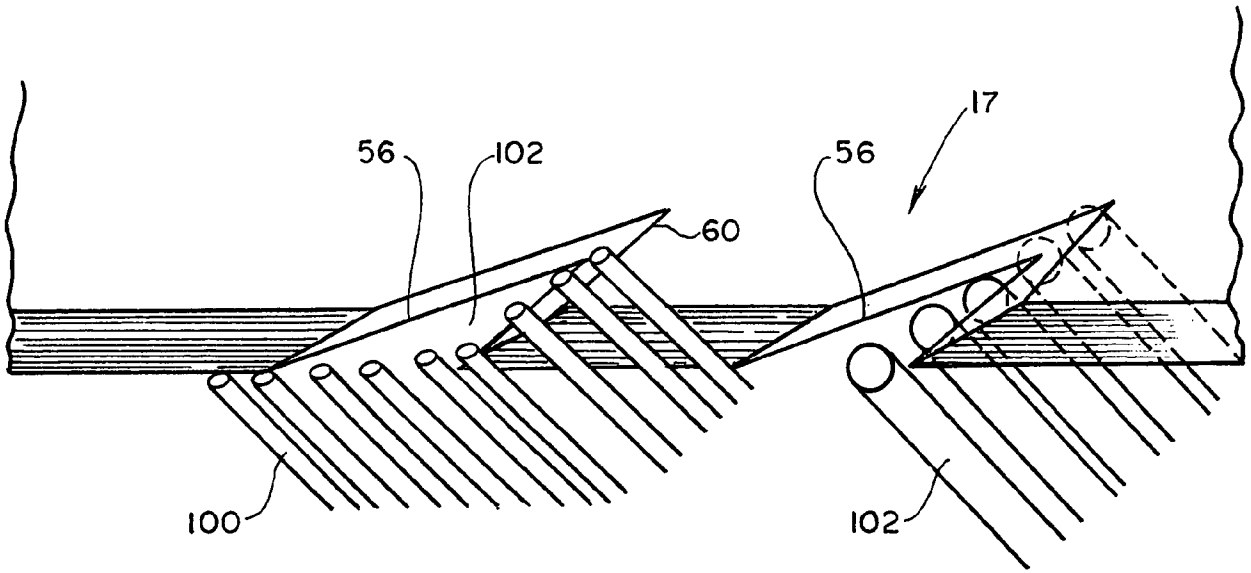
FIG. 2 is a schematic view illustrating severing of a single strand rope, both thin rope and relatively large rope.

In operation, the user grasps the handle 12 and positions the blade 14 in alignment with the rope that needs to be severed. By moving the knife away from the user's body, the user causes some of the strands of the rope to enter the V-shaped notches 102 formed by the sides of the serrated teeth 22 or 23. The strands 100 (seen in FIG. 2) slide along the sharpened apexes of the beveled surfaces and become cut when the user moves the knife in a sawing motion. Depending on the number of strands, thickness of strands and the make-up of the rope, the strands 100 become cut with one or two strokes of sawing motions.

Figure 3:
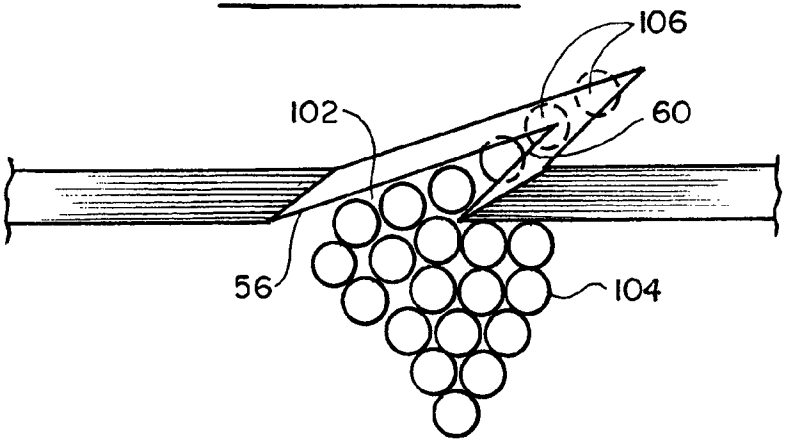
FIG. 3 is a schematic view illustrating cutting of a twisted rope.

If the rope is formed as a bundle, for instance twisted or braided, such as rope 104 shown schematically in FIG. 3, the forward movement of the knife 10 causes some of the strands 106 to become separated from the bundle 104 and become caught in the notches 102 and severed when forced in contact with the apexes 56 and 60. Since the apexes 56 and 60 are sharpened and formed by opposing beveled surfaces the possibility of the strand fraying is minimized. The rope strands become tensioned between the apexes, which facilitates cutting.

By performing a sawing motion, the user continues to separate and cut individual strands of the twisted and braided rope until the entire thickness of the rope has been cut. The user performs as many cuts as necessary to free the shaft or propeller from the entangling rope.

Often times, in seafaring and other instances, the rope wraps on itself, in effect locking itself on the propeller shaft of other parts underwater and appears as an irregular spool, not neat like a spool. The rope can start at the top and it can almost be at the bottom, the same length of rope may come at different angles, different positions, which exacerbates the problem. Most of the times, it becomes impossible to unravel this bundle and the only sensible thing is to cut through it.

Due to space limitation, it becomes impossible to use large tools, such as saws and the like. The present invention provides solution to this problem by offering a small hand tool in the form of a knife that can cut through thick ropes, either made from natural or man-made material. One of the benefits of the present invention is that it slices through the rope, tearing the rope without leaving behind remnants.

Most conventional knives rely on a razor edge. That works on the flat of the knife with very fine minute teeth to do the cutting of the rope and very soon the knives will start getting dull, progressively losing the ability to cut. Conventional serrated knives perform not much better. When applied to the job of cutting nylon ropes, the serrated knives often have the serrated teeth break off, while fraying the rope along the cut line.

The instant invention solves these problems in an easy and efficient manner. Depending on the length of the desired blade, the knife may have five or more teeth along each edge, with several notches, which capture several strands at a time and facilitate the cutting of the rope. The speed of cutting using the instant invention is significantly improved, which shortens the time a diver needs to spend underwater.

The dimensions of the blade and the handle can differ depending on the manufacturing design. The spacing of the notches can also be calculated to achieve the most beneficial result.

Many changes and modifications can be made in the design of the present invention without departing from the spirit thereof. I therefore, pray that my rights to the present invention be limited only by the scope of the appended claims.

I claim:

1. A method of severing a rope, comprising the steps of:

providing a knife having a handle and a blade secured to said handle, the blade having a first cutting edge and a second cutting edge, each of said cutting edges being provided with a plurality of notches oriented at an acute angle in relation to a longitudinal axis of the blade, each of said notches being defined by a first linear side and a second linear side, each of said first side and said second side being formed with sharpened surfaces, said blade having a front and a back;

providing said first linear side with a bevel surface formed on the front side and a bevel surface formed on the back, the bevel surface on the back being a mirror-image of the bevel surface on the front, and wherein the bevel surfaces of the front and the back intersect along a sharpened cutting edge;

providing said second linear side with a bevel surface formed on the front and a bevel surface formed on the back, and wherein the bevel surfaces of the front and the back intersect along a sharpened cutting edge, the sharpened cutting edge of the first side and the sharpened cutting edge of the second side extending at an acute angle in relation to each other;

engaging the rope with said blade such that strands of the rope enter the notches; and causing the blade to move against the rope strands, tensioning the rope strands within the notches, and applying a cutting force on the rope by opposing sharpened cutting edges of the first side and the second side.

2. The method of claim 1, further comprising the step of forming said second side to extend at an angle of between 45 and 70 degrees in relation to the longitudinal axis of the blade.

3. The method of claim 1, wherein each of said first edge and said second edge is provided with a plurality of serrated teeth formed along the length of the first edge and the second edge, and wherein each of said serrated teeth is provided with a sharp point oriented away from the handle at an acute angle to the longitudinal axis of the blade.

4. The method of claim 3, wherein said sharp point is provided with beveled surfaces.

5. The method of claim 1, further comprising a step of forming said blade with a tip portion, and wherein said tip portion has beveled surfaces.

6. The method of claim 1, wherein said notches have a generally V-shaped configuration, narrowing toward the longitudinal axis of the blade.

7. The method of claim 1, wherein the step of causing the blade to move against the rope strands includes the step of moving the blade in a sawing motion against the sharpened cutting edges of the first side and the second side.

* * * * *